US012024356B2

(12) United States Patent
Darst et al.

(10) Patent No.: US 12,024,356 B2
(45) Date of Patent: Jul. 2, 2024

(54) MULTIPLE COMPARTMENT CONTAINER AND METHODS

(71) Applicant: Apothecary Products, LLC, Burnsville, MN (US)

(72) Inventors: Daniel Darst, Zimmerman, MN (US); Randall Wayne Nichols, Watertown, MN (US)

(73) Assignee: Apothecary Products, LLC, Burnsville, MN (US)

( * ) Notice: Subject to any disclaimer, the term of this patent is extended or adjusted under 35 U.S.C. 154(b) by 0 days.

(21) Appl. No.: 17/956,260

(22) Filed: Sep. 29, 2022

(65) Prior Publication Data

US 2024/0109713 A1 Apr. 4, 2024

(51) Int. Cl.
*B65D 83/04* (2006.01)

(52) U.S. Cl.
CPC .. *B65D 83/0445* (2013.01); *B65D 2583/0409* (2013.01); *B65D 2585/56* (2013.01)

(58) Field of Classification Search
CPC ..... B65D 83/0445; B65D 2583/0409; B65D 2585/56
USPC ..... 206/528, 530, 538–540; 220/23.8
See application file for complete search history.

(56) References Cited

U.S. PATENT DOCUMENTS

| | | | | |
|---|---|---|---|---|
| 4,372,445 | A * | 2/1983 | Keffeler | B65D 21/0204 206/532 |
| 4,793,492 | A * | 12/1988 | Halbich | A61J 7/0084 206/538 |
| 5,599,595 | A | 2/1997 | Mcginley et al. | |
| 5,735,406 | A | 4/1998 | Keffeler | |
| 7,494,012 | B1 * | 2/2009 | Priebe | B65D 83/0445 206/538 |
| 7,624,890 | B2 * | 12/2009 | Noble | B65D 83/0445 206/538 |
| 7,798,330 | B2 * | 9/2010 | Noble | B65D 83/04 206/533 |
| D696,010 | S | 12/2013 | Priebe et al. | |
| 10,420,703 | B1 * | 9/2019 | Lee | A61J 1/03 |
| D897,666 | S | 10/2020 | Guo et al. | |
| 11,440,714 | B2 * | 9/2022 | Wang | B65D 55/02 |
| 2003/0043026 | A1 * | 3/2003 | Noble | A61J 7/0472 340/309.16 |
| 2009/0114562 | A1 * | 5/2009 | Noble | A61J 7/04 206/538 |
| 2009/0166243 | A1 | 7/2009 | Cetera | |
| 2014/0251863 | A1 * | 9/2014 | Priebe | A61J 1/03 206/534 |

FOREIGN PATENT DOCUMENTS

| | | | |
|---|---|---|---|
| CN | 102100436 | A | 6/2011 |
| EP | 766333 | A1 | 4/1997 |

OTHER PUBLICATIONS

International Search Report and Written Opinion for PCT/US2023/075367 (Jan. 25, 2024).

* cited by examiner

*Primary Examiner* — Luan K Bui
(74) *Attorney, Agent, or Firm* — Merchant & Gould P.C.

(57) ABSTRACT

A multiple compartment container includes a push tab assembly having a series of push tabs connected together as a one-piece molded assembly. The container has lids that are molded in a single piece with the base of the container.

8 Claims, 8 Drawing Sheets

MULTIPLE COMPARTMENT CONTAINER AND METHODS

TECHNICAL FIELD

This disclosure relates to containers with multiple compartments and hinged mating lids and methods of use. The containers are commonly used to store pills.

BACKGROUND

Containers with hinged mating lids are known. One type of container is described in U.S. Pat. No. 7,624,890, incorporated herein by reference. This container includes a plurality of pivoting push buttons/tabs to move a selected lid into an open position. Improvements are desirable.

SUMMARY

To improve the prior art, a multiple compartment container arrangement is provided.

In one aspect, a multiple compartment container arrangement has a first container including (a) a base having a plurality of compartments, each compartment having an access opening providing access to an interior volume; (i) the base having a front wall, a rear wall opposite of the front wall, a first side wall extending between the front wall and rear wall, a second side wall extending between the front wall and rear wall, and a bottom wall opposite of the access opening; (ii) the base further including an engagement member on the front wall; (b) a plurality of lids; each lid being movably attached to the rear wall about a pivot axis and having a free end movable to and away from the front wall such that the lid selectively covers and uncovers the access opening of a respective compartment; (i) each lid further including a lid catch at the free end releasably engaging the engagement member on the front wall of the base; and (c) a one-piece molded tab arrangement; the one-piece molded tab arrangement including a plurality of connected tabs, each tab being pivotably connected to the base at a location opposite the front wall from the interior volume, wherein depressing a front portion of the tab causes a rear portion of the tab to contact a respective lid and disengage the free end of the lid from the front wall of the base and thereby position the lid to uncover the access opening.

In an example embodiment, the plurality of lids and the base are a single, molded piece.

In example embodiments, the base has seven compartments positioned side-by-side.

The container arrangement may further include (a) a holding tray with a bottom wall, a surrounding side wall, and a middle partition extending between opposite portions of the side wall; (b) a second container; the second container being constructed the same as the first container; and wherein the first container and second container are removably positionable in the holding tray, with middle partition therebetween.

In one or more examples, the one-piece molded tab arrangement comprises: (a) an elongate bar having opposite first and second ends, an outer face, and an opposite container-engaging face; and (b) a plurality of tab assemblies connected to the bar in a side-by-side manner between the first and second ends, each of the tab assemblies having one of the tabs.

In some embodiments, each of the tab assemblies includes an extension with a container engaging hook attached to the base.

In another aspect, a one-piece molded tab arrangement for use with a multiple compartment container having a plurality of openable and closeable lids is provided. The tab arrangement comprising: (a) an elongate bar having opposite first and second ends, an outer face, and an opposite container-engaging face; and (b) a plurality of tab assemblies connected to the bar in a side-by-side manner between the first and second ends.

In example arrangements, each of the tab assemblies includes: (a) an extension with a container engaging hook extending in a direction from the container-engaging face and away from a remaining part of the tab assembly; and (b) a push tab extending in a direction from the outer face and in a direction opposite of the container engaging hook.

Each of the tab assemblies may include a fulcrum support for each of the push tabs.

In an embodiment, each of the tab assemblies includes a lid engagement member extending from the push tab positioned to engage a lid of the container.

In another aspect, a method of storing items in a multiple compartment container is provide; the method comprising: (a) providing a container with a base having a plurality of compartments; a plurality of lids movably attached to the base to selectively cover and uncover the compartments; each lid including a lid catch at the free end releasably engaging an engagement member on the base; and a one-piece molded tab arrangement including a plurality of connected tabs each tab pivotably connected to the base; and (b) pressing a front portion of one of the tabs to cause a rear portion of the tab to contact a respective lid and disengage the free end of the lid from the base and uncover the respective compartment.

The step of providing can include providing the container such that the plurality of lids and the base are a single, molded piece.

The step of providing may include providing the one-piece molded tab arrangement to include: (a) an elongate bar having opposite first and second ends, an outer face, and an opposite container-engaging face; and (b) a plurality of tab assemblies connected to the bar in a side-by-side manner between the first and second ends, each of the tab assemblies having one of the tabs.

The method may further include: (a) after the step of pressing, placing one or more pills in the uncovered compartment; and (b) covering the compartment having the one or more pills with the respective lid and engaging the lid catch with the engagement member on the base.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 1:
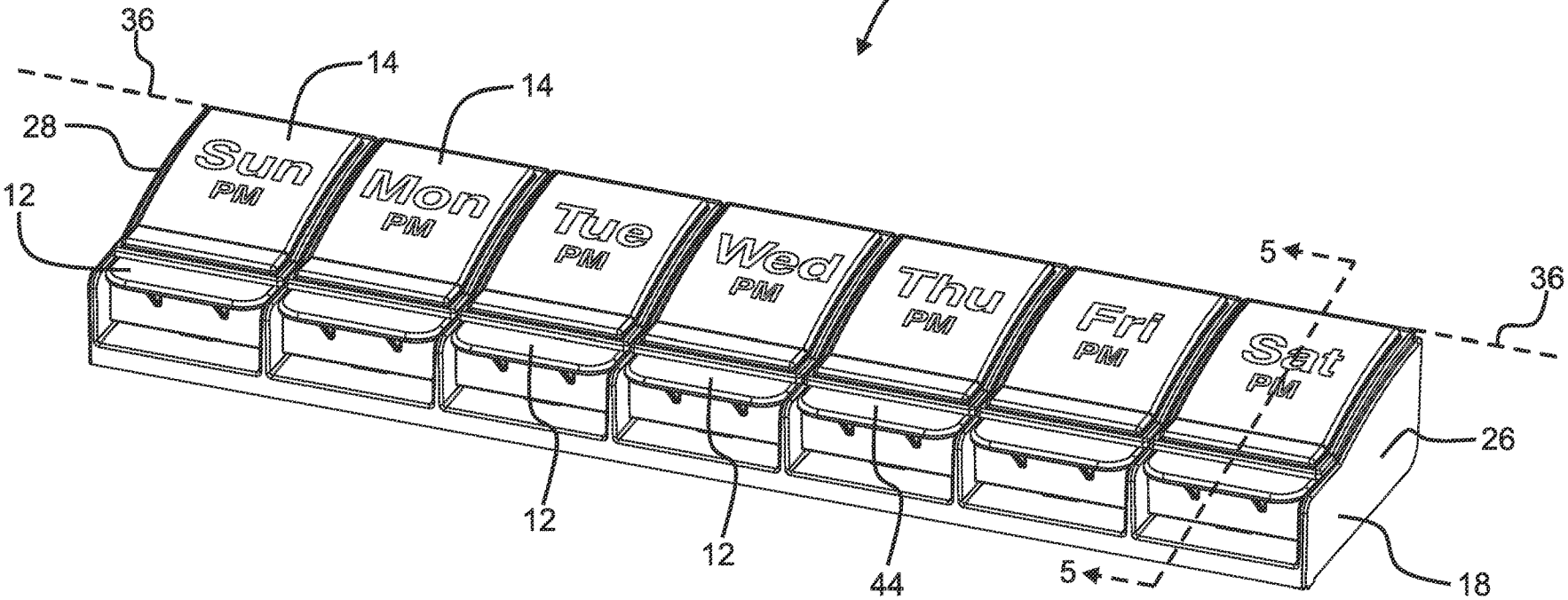
FIG. 1 is a perspective view of an embodiment of a multiple compartment container, constructed in accordance with principles of this disclosure.
Figure 6:
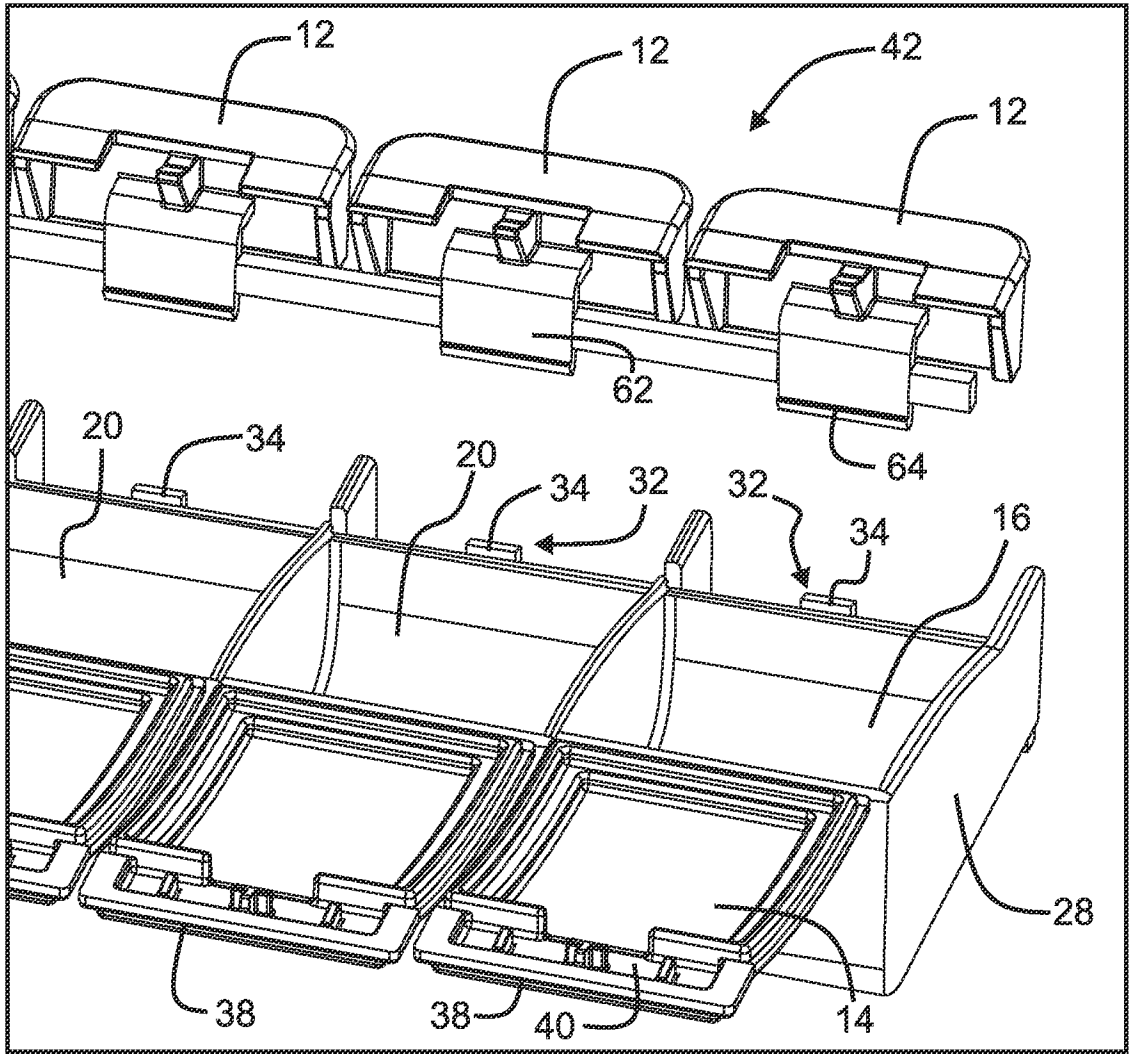
FIG. 6 is a schematic, exploded perspective view of a portion of the container of FIG. 1 and showing the lids in an open position.

FIG. 1 shows an embodiment of a multiple compartment container 10, constructed in accordance with principles of this disclosure. In FIG. 1, a plurality of push buttons or tabs can be seen at 12. A plurality of covers or lids 14 is also visible. In general, depressing a front portion of one of the tabs 12 causes a rear portion of that tab 12 to contact the respective lid 14 and disengage the lid 14 and thereby position the lid 14 to uncover an access opening 16 (FIG. 6) in the container 10.

In reference now to FIGS. 1, and 4-6, the container 10 includes a base 18. The base 18 defines a plurality of compartments 20 (FIG. 6), each having respective access opening 16 (FIG. 6) to provide access to an interior volume of the respective compartment 20. In this embodiment, the compartments 20 are arrangement side-by-side in a straight line. The example embodiment shows 7 compartments 20, each marked for the day of the week, and can also include an indication if it is for morning (AM) or as shown in FIG. 1 for afternoon/evening (PM). In other embodiments, more or fewer compartments can be used.

The base 18 has a front wall 22 (FIG. 4), a rear wall 24 (FIG. 5) opposite of the front wall 22, a first side wall 26 extending between the front wall 22 and rear wall 24, a second side wall 28 extending between the front wall 22 and rear wall 24, and a bottom wall 30 opposite of the access openings 16. Because the compartments 20 are arranged side by side, the front wall 22 is common to all compartments 20; the rear wall 24 is common to all compartments 20; and the bottom wall 30 is common to all compartments 20.

The base 18 further includes an engagement member 32 (FIGS. 5 and 6) such as a projecting hook 34 on the front wall 22. The engagement member 32 is for releasably engaging one of the respective lids 14, as explained further.

The disclosed configuration prevents the tabs 12 from being inadvertently actuated. In the depicted embodiment, and in reference to FIG. 4, a front end 92 of the base 18 includes tab guard walls 94 that extend perpendicular from the front wall 22. In the depicted embodiment, each of the tabs 12 is shielded from the sides by vertical guard walls 94 and from the bottom by a horizontal (bottom) guard wall 96.

Each of the lids 14 is movably attached to the rear wall 24 about a pivot axis 36 (FIG. 1). Each lid 14 has a free end 38 movable to and away from the front wall 22 such that the lid 14 selectively covers and uncovers the access opening 16 of its respective compartment 20.

Each lid 14 further including a lid catch 40 at the free end 38 releasably engaging the engagement member 32, such as the hook 34, on the front wall 22 of the base 18.

In accordance with principles of this disclosure, the plurality of lids 14 and the base 18 are a single, molded piece. For example, the lids 14 and base 18 can be made in an injection molding process using plastic. This has the technical effect of simplifying the assembly process and resulting in a robust longer lasting design.

Figure 2:
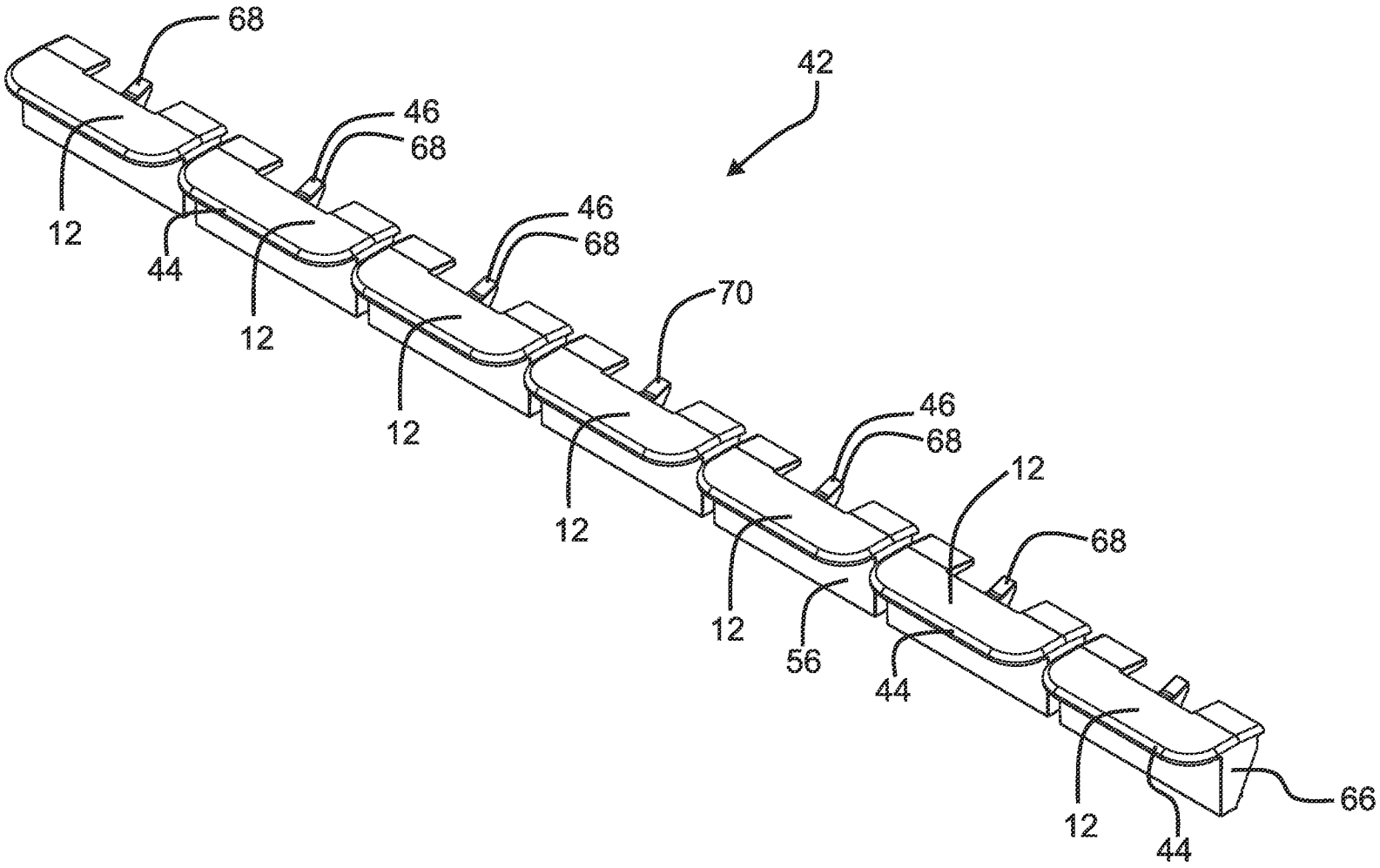
FIG. 2 is a perspective view of an embodiment of a one-piece molded tab arrangement, used in the container of FIG. 1, constructed in accordance with principles of this disclosure.
Figure 3:
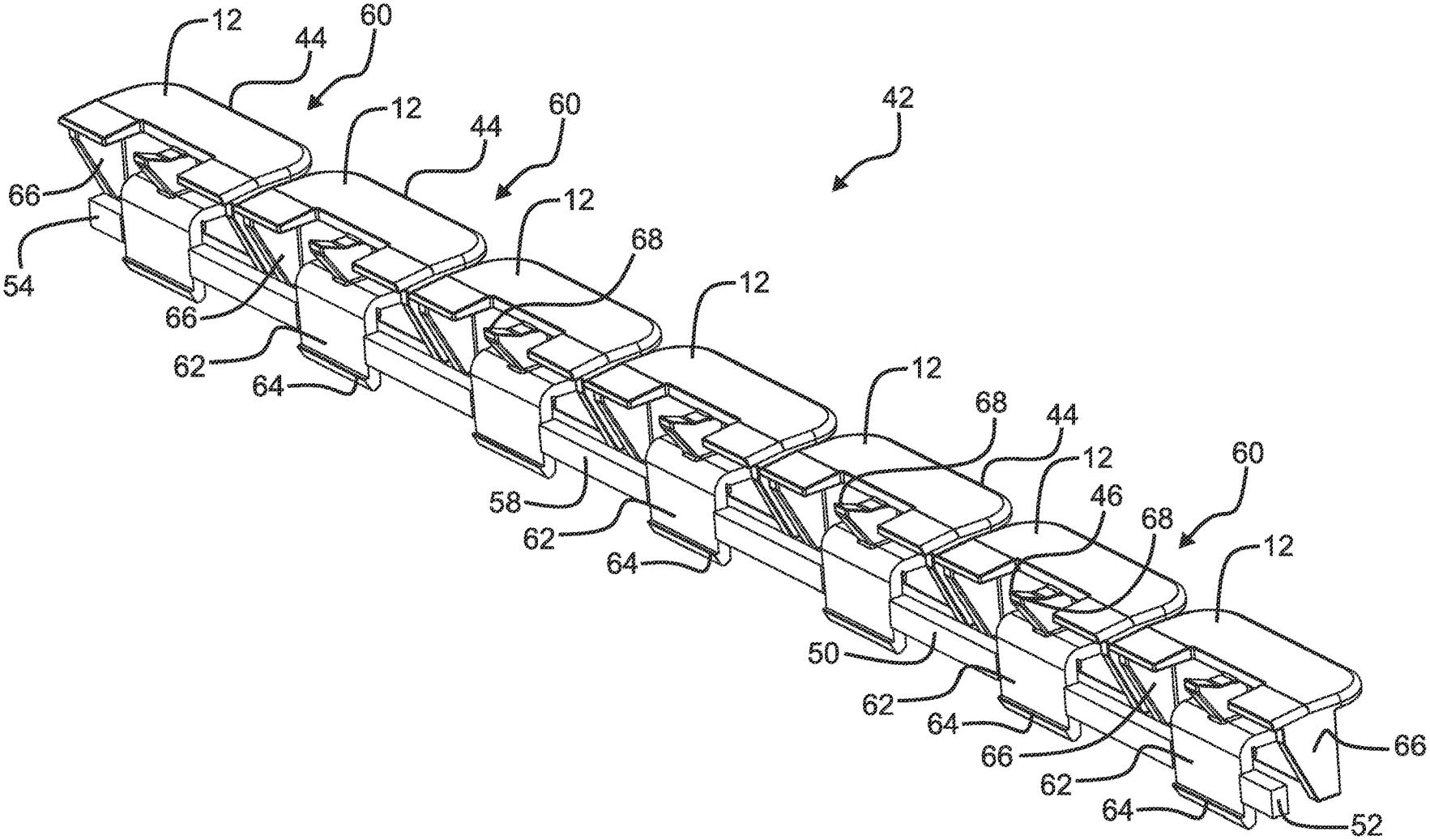
FIG. 3 is another perspective view of the one-piece molded tab arrangement of FIG. 2.
Figure 4:
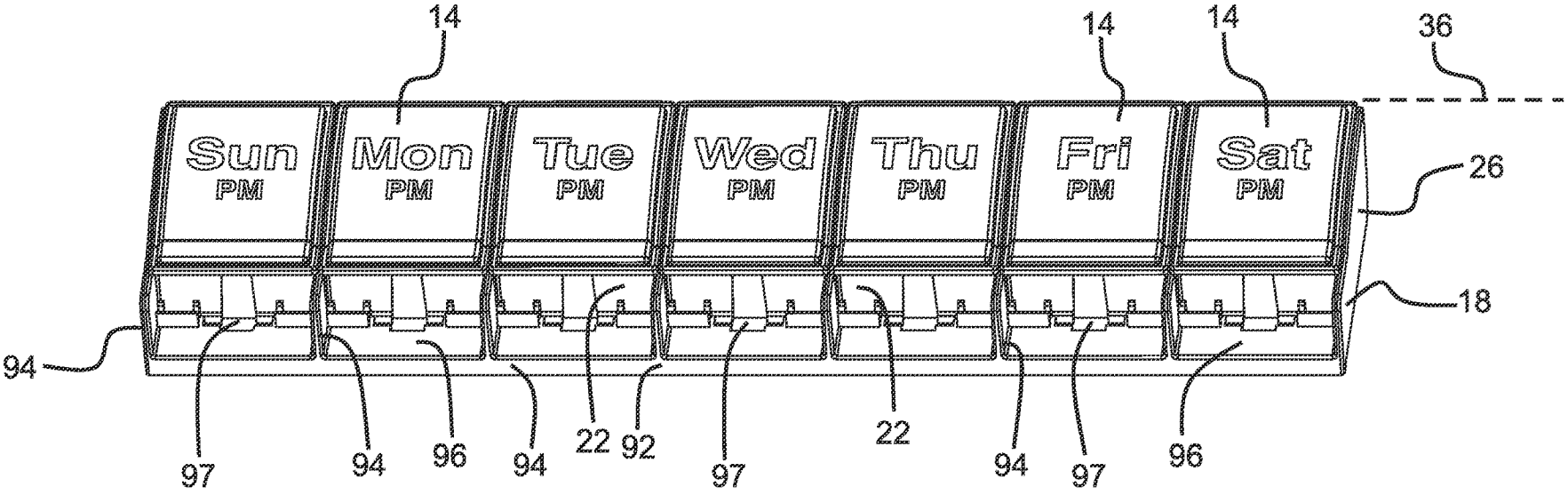
FIG. 4 is a perspective view of an embodiment of a base and lids, used in the container of FIG. 1, constructed in accordance with principles of this disclosure.
Figure 5:
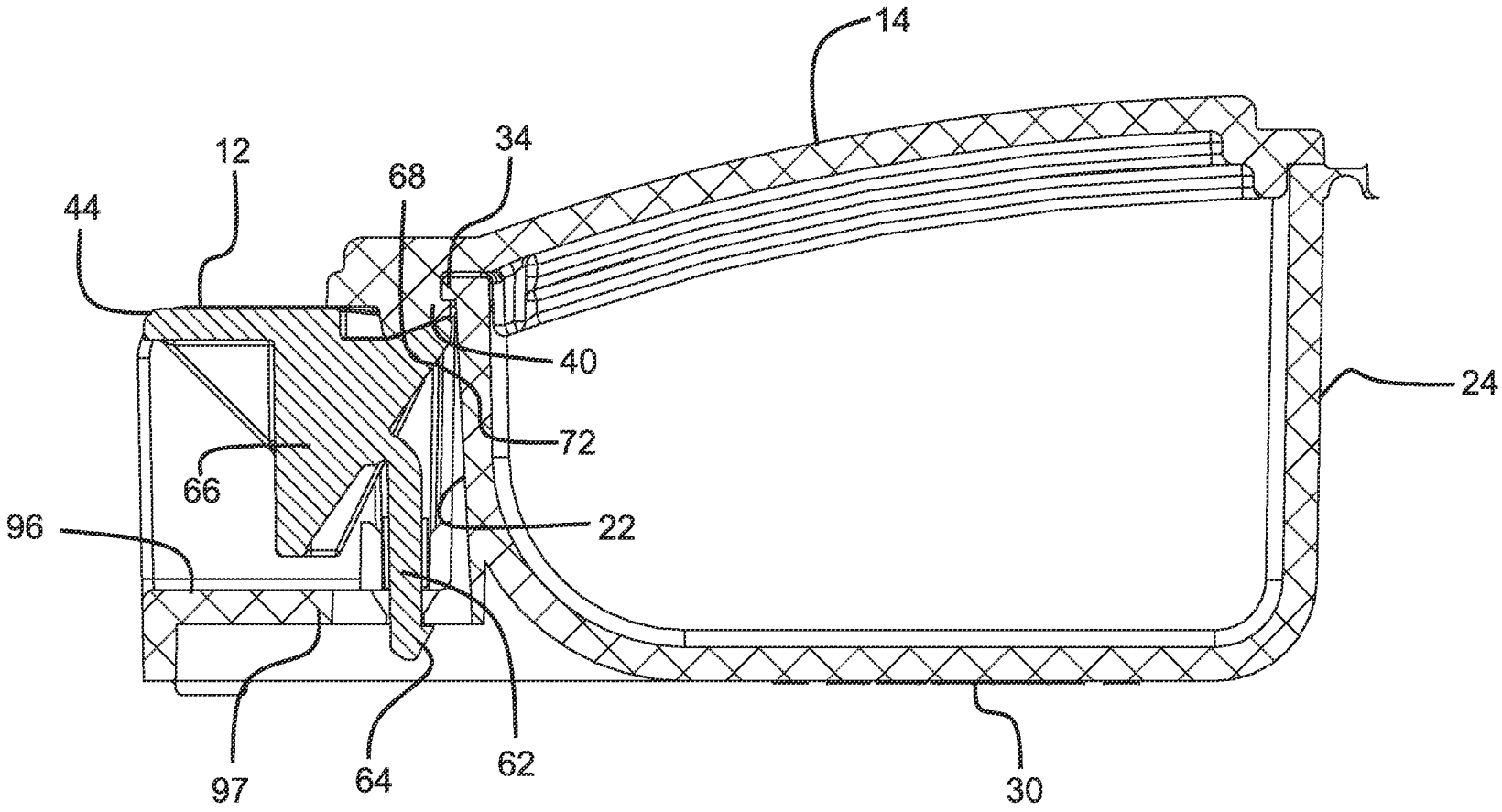
FIG. 5 is a cross-sectional view of the container of FIG. 1, the cross-section taken along the line 5-5 of FIG. 1.

In accordance with principles of this disclosure and in reference now to FIGS. 2 and 3, the tabs 12 are part of a one-piece molded tab arrangement 42. The one-piece molded tab arrangement 42 includes a plurality of the tabs 12 connected (molded) together. Each tab 12 is pivotably connected to the base 18 at a location opposite the front wall 22 from the interior volume of the compartment 20, wherein depressing a front portion 44 of the tab 12 causes a rear portion 46 of the tab 12 to contact a respective lid 14 and disengage the free end 38 of the lid 14 from the front wall 22 of the base 18 and thereby position the lid 14 to uncover the access opening 16.

The one-piece molded tab arrangement 42 can be made in an injection molding process using plastic. This has the technical effect of simplifying the assembly process and resulting in a robust, longer lasting design.

The tab arrangement 42 includes an elongate bar 50 (FIG. 3) having opposite first and second ends 52, 54. The tab arrangement 42 has an outer face 56 (FIG. 2), and an opposite container-engaging face 58 (FIG. 3).

The tab arrangement 42 includes a plurality of tab assemblies 60 connected to the bar 50 in a side-by-side manner between the first and second ends 52, 54. Each of the tab assemblies 60 includes an extension 62 with a container engaging hook 64 extending in a direction from the container-engaging face 58 and away from a remaining part of the tab assembly 60. Each tab assembly also includes one of the tabs 12 (push button or push tab 12) extending in a direction from the outer face 56 and in a direction opposite of the container engaging hook 64. The extensions 62 are each received within a respective aperture 97 (FIGS. 4 and 5) of the horizontal (bottom) wall 96 of the tab guard. Each of the hooks 64 catch the wall 96 to help hold the tab arrangement 42 in place relative to the base 18.

Each of the tab assemblies 60 includes a fulcrum support 66 for each of the tabs 12. The fulcrum support 66 allows for the pivoting of the tab 12 to pry the respective lid 14 from engagement with the base 18 and move the lid 14 to a position exposing the interior volume of the respective compartment 20.

Each of the tab assemblies 60 includes a lid engagement member 68 extending from the tab 12 positioned to engage its respective lid 14 of the container 10. In particular, the lid engagement member 28 has an upper surface 70 (FIG. 2) that contacts an opposing downward facing surface 72 (FIG. 5) of the free end 38 of the lid 14. When the front portion 44 of the tab 12 is pushed (pressed/depressed), the tab 12 pivots the rear portion 26 upwardly such that the upper surface 70 pushes the downward facing surface 72 of the lid 14 and disengages the connection between the lid catch 40 and the engagement member 32, such as hook 34.

Figure 7:
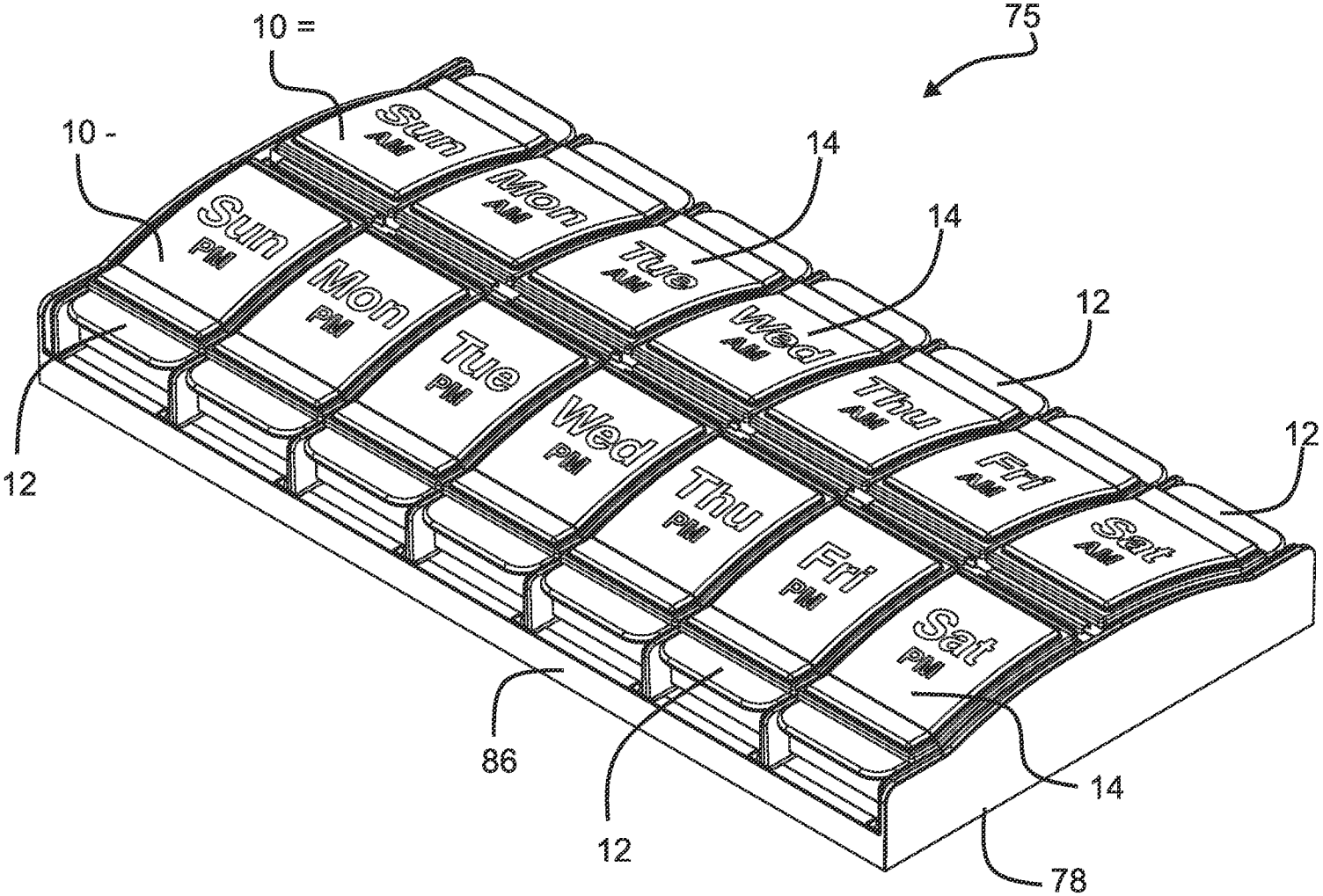
FIG. 7 is a perspective view of an embodiment of a multiple compartment container arrangement having a first container like FIG. 1 and a second container constructed identically to FIG. 1 positioned in a holding tray, constructed in accordance with principles of this disclosure.
Figure 8:
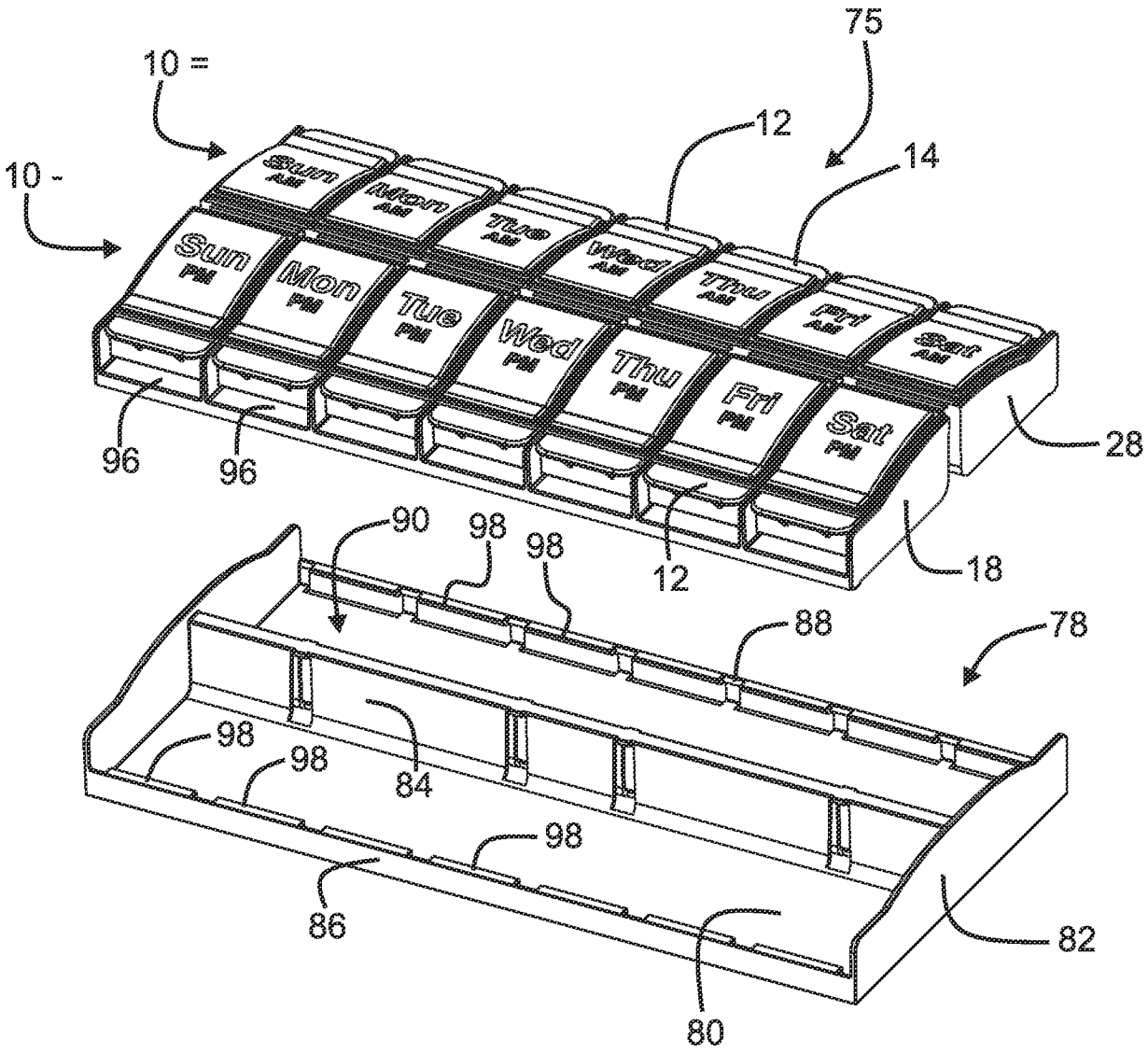
FIG. 8 is an exploded perspective view of the container arrangement of FIG. 7.

In reference now to FIGS. 7 and 8, a container arrangement 75 is shown. The container arrangement 75 includes a holding tray 78 and two of the containers 10, shown here as first container 10' and second container 10".

The tray 78 includes a bottom wall 80, a surrounding side wall 82, and a middle partition 84 extending between opposite portions of the side wall 82. The bottom wall 80 and surrounding side wall 82 contain an interior volume 90 therein.

The first container 10' and second container 10" are removably positionable in the interior volume 90 of the holding tray 78, with the middle partition 54 therebetween. This arrangement 75 can be used for either a 14 day pill assembly, or a 7 day pill assembly, with one of the containers 10', 10" being for the morning (AM) and the other of the containers 10', 10" being for the afternoon or evening (PM).

As can be seen in FIG. 8, the surrounding side wall 82 has opposite longitudinal walls 86, 88, which extend along the front walls 22 of the base 18 of the containers 10', 10". Projecting inwardly toward the interior volume 90 from a terminal edge of each of the longitudinal walls 86, 88 are ribs 98. The ribs 98 snap over the horizontal (bottom) wall 96 and help to secure the containers 10', 10" in place.

The above assemblies can be used in a method of storing items (e.g., pills) including providing the container 10 and pressing the front portion 44 of one of the tabs 12 to cause the rear portion 46 to contact its respective lid 14 and disengage the free end 38 of the lid 14 from the base 18 and uncover the respective compartment 20.

The step of providing the container 10 includes providing the container 10 such that the plurality of lids 14 and the base 18 are a single, molded piece.

The step of providing includes providing the one-piece molded tab arrangement 42 to include: the elongate bar 50 having opposite first and second ends 52, 54, outer face 56, and opposite container-engaging face 58; and the plurality of tab assemblies 60 connected to the bar 50 in a side-by-side manner between the first and second ends 52, 54, each of the tab assemblies 60 having one of the tabs 12.

The method further includes, after the step of pressing, placing one or more pills in the uncovered compartment 20; and covering the compartment 20 having the one or more pills with the respective lid 14 and engaging the lid catch 40 with the engagement member 32 on the base 18.

The above are example principles. Many embodiments can be made using these principles.

What is claimed is:

1. A multiple compartment container arrangement comprising:

a first container including, (a) a base having a plurality of compartments, each compartment having an access opening providing access to an interior volume;

(i) the base having a front wall, a rear wall opposite of the front wall, a first side wall extending between the front wall and rear wall, a second side wall extending between the front wall and rear wall, and a bottom wall opposite of the access opening;

(ii) the base further including an engagement member on the front wall;

(b) a plurality of lids; each lid being movably attached to the rear wall about a pivot axis and having a free end movable to and away from the front wall such that the lid selectively covers and uncovers the access opening of a respective compartment;

(i) each lid further including a lid catch at the free end releasably engaging the engagement member on the front wall of the base; and (c) a one-piece molded tab arrangement; the one-piece molded tab arrangement including a plurality of connected tabs, each tab being pivotably connected to the base at a location opposite the front wall from the interior volume, wherein depressing a front portion of the tab causes a rear portion of the tab to contact a respective lid and disengage the free end of the lid from the front wall of the base and thereby position the lid to uncover the access opening;

wherein the one-piece molded tab arrangement comprises, (i) an elongate bar having opposite first and second ends, an outer face, and an opposite container-engaging face; and (ii) a plurality of tab assemblies connected to the bar in a side-by-side manner between the first and second ends, each of the tab assemblies having one of the tabs.

2. The container arrangement of claim 1 wherein the plurality of lids and the base are a single, molded piece.

3. The container arrangement of claim 1 wherein the base has seven compartments positioned side-by-side.

4. The container arrangement of claim 1 further including:

(a) a holding tray with a bottom wall, a surrounding side wall, and a middle partition extending between opposite portions of the side wall;

(b) a second container; the second container being constructed the same as the first container; and wherein the first container and second container are removably positionable in the holding tray, with the middle partition therebetween.

5. The container arrangement of claim 1 wherein each of the tab assemblies includes an extension with a container engaging hook attached to the base.

6. A multiple compartment container arrangement comprising:

a first container including, (a) a base having a plurality of compartments, each compartment having an access opening providing access to an interior volume;

(i) the base having a front wall, a rear wall opposite of the front wall, a first side wall extending between the front wall and rear wall, a second side wall extending between the front wall and rear wall, and a bottom wall opposite of the access opening;

(ii) the base further including an engagement member on the front wall;

(b) a plurality of lids; each lid being movably attached to the rear wall about a pivot axis and having a free end movable to and away from the front wall such that the lid selectively covers and uncovers the access opening of a respective compartment;

(i) each lid further including a lid catch at the free end releasably engaging the engagement member on the front wall of the base;

(c) a one-piece molded tab arrangement; the one-piece molded tab arrangement including a plurality of connected tabs, each tab being pivotably connected to the base at a location opposite the front wall from the interior volume, wherein depressing a front portion of the tab causes a rear portion of the tab to contact a respective lid and disengage the free end of the lid from the front wall of the base and thereby position the lid to uncover the access opening;

(d) a holding tray with a bottom wall, a surrounding side wall, and a middle partition extending between opposite portions of the side wall; and (e) a second container; the second container being constructed the same as the first container; and wherein the first container and second container are removably positionable in the holding tray, with the middle partition therebetween.

7. The container arrangement of claim 6 wherein the plurality of lids and the base are a single, molded piece.

8. The container arrangement of claim 6 wherein the base has seven compartments positioned side-by-side.

* * * * *